United States Patent [19]

Mogler

[11] 4,202,463

[45] May 13, 1980

[54] STOPPERS FOR PRESSURE CONTAINERS

[75] Inventor: Joachim Mogler, Eppingen, Fed. Rep. of Germany

[73] Assignee: Datograf Apparatebau GmbH & Co., Heilbronn, Fed. Rep. of Germany

[21] Appl. No.: 11,539

[22] Filed: Feb. 12, 1979

[30] Foreign Application Priority Data

Feb. 19, 1978 [DE] Fed. Rep. of Germany ..... 2806759
May 13, 1978 [DE] Fed. Rep. of Germany ..... 2821051

[51] Int. Cl.[2] ..... B65D 51/16
[52] U.S. Cl. ..... 220/307; 220/240; 220/DIG. 19; 217/110
[58] Field of Search ..... 220/307, 240, DIG. 19; 217/98; 285/202, 203

[56] References Cited

U.S. PATENT DOCUMENTS 3,998,354 12/1976 Song ..... 220/307 X
4,140,235 2/1979 Rausing et al. ..... 220/307 X

*Primary Examiner*—George P. Hall
*Attorney, Agent, or Firm*—Lawerence E. Laubscher

[57] ABSTRACT

A stopper for a pressure container comprises a hole fitting and an inner core for sealing engagementin a generallycylindrical inner bore of the hole fitting. The hole fitting has an annular external groove for receiving a generally circular edge of the container which edge defines an opening in the container. The part of the hole fitting immediately below the groove is of larger external diameter than the opening in the container, and the core has a non-sealing section of less external diameter than the internal diameter of the adjacent length of the bore. Such a stopper is easier to insert in the container opening.

13 Claims, 6 Drawing Figures

STOPPERS FOR PRESSURE CONTAINERS

BACKGROUND OF THE INVENTION

The invention relates to a stopper for a pressure container, in particular for a container containing a fluid under pressure, such as beer.

For the closing of pressure containers having a generally circular opening, a hole fitting has previously been used which has an inner through-bore closed at its lower end by means of a cover. The cover is a form-fit connection with the hole fitting and is thus prevented from being pushed out from the inside through the hole fitting by the pressure present in the interior of the container. Thus, after the filling of the container, the hole fitting closed in this manner at its lower end is pressed into the opening of the container lid. The edge of the lid then snaps into an annular groove on the outside of the hole fitting, so as to prevent the hole fitting from sliding axially. The inner bore is thereby closed only at its lower end and for protection against soiling a dust cap is pressed into the top end of the hole fitting to close it.

To open the stopper, the dirt or dust cap is first removed by hand. The shaft of a dispenser or discharge fitting is then inserted into the inner bore of the hole fitting, and lies tightly against the inner surface of the hole fitting when slid in. On being slid in still further, the shaft pushes into the interior of the container the cover of which closes the inner bore at its bottom end. The container interior is then sealed by the shaft lying tightly against the inner wall of the hole fitting. The liquid in the container, e.g. beer, can then be dispensed using the discharge fitting.

This stopper is constructionally expensive as it consists of three separate pieces. A further drawback is that in practice the dust cap must have an opening through which the sealed inner bore is connected to the atmosphere. If the cover is then not completely tight, with the result that liquid residues such as beer residues collect inside the inner bore, then these can quickly decay under the influence of the entering air. When the stopper is to be opened, these decayed liquid quantities can only be removed from the inner bore with difficulty, or indeed not at all, and they are usually forcibly pushed into the container with the hole fitting. Such a stopper does therefore not satisfy hygiene requirements for the use of such stoppers in drink containers.

In order to prevent such dirt collection in the inner bore, the inner bore has been closed at its lower end with a plug which nearly completely fills the inner bore when slid in. In a known construction, the cover which closes the inner bore at its lower end is extended in a substantially cylindrical form as far as the region of the upper edge of the inner bore. In order to obtain good sealing, this cylinder-shaped plug is constructed of a harder material than that of the hole fitting which surrounds it.

Although this stopper can dispense with a separate dust seal, soiling in the region of the inner bore of such an assembly is however not completely eliminated. As the inner core typically ends at a small distance from the top end of the hole fitting, a depression is formed in the central region of the hole fitting which comprises an edge at the boundary surface between the inner bore and the top of the plug. Dirt residues can deposit in the region of this edge, which is relatively inaccessible for difficult cleaning.

Because of the substantially cylindrical construction of the plug in its upper region, it becomes much more difficult to squeeze the hole fitting into the hole in the vicinity of the annular groove provided along its circumference. In order to press the hole fitting, closed by the plug, into the opening in the container lid, a substantially higher force must therefore be applied, which not only makes the stopper more difficult to insert in practice, but can also lead to damage of a thin container lid.

SUMMARY OF THE INVENTION

An object of the invention is to provide an improved stopper, such that even when using inserted plugs which have substantially the same length as the hole fitting, the hole fitting can be easily pressed into the opening in the container lid.

It is a second object to provide a stopper in which neither the seal effect nor the facility for pushing the plug out, i.e. opening the stopper, should in any way be impaired. In particular, in pushing the plug out of the hole fitting, there should be no danger of the hole fitting itself also being pushed through the opening in the container lid and into the container interior together with the plug.

These and other objects can be achieved in accordance with the present invention by providing an inner core which is generally a tight, sealing fit in the inner bore of a hole fitting but which has a non-sealing middle section in the vicinity of that part of the hole fitting which is immediately below the annular groove towards the top of the hole fitting. The part of the hole fitting immediately below the groove is of larger external diameter than the opening in the container. The provision of a core with a non-sealing section of less external diameter than the internal diameter of the adjacent length of the bore means that the hole fitting can be easily compressed as it is pushed into the lid opening; the inner core allows the wall of the hole fitting to give way inwards.

DESCRIPTION OF THE PREFERRED EMBODIMENTS

More particularly, in fulfillment of the objects of the invention, there is provided a stopper for a pressure container which has a generally circular edge defining an opening of the container, the stopper comprising a hole fitting of resilient material with a substantially cylindrical inner bore and an inner core of substantially the same height as the hole fitting for insertion in the bore to seal thereagainst. The hole fitting has an annular external groove for receiving the generally circular edge of the container and has a main body below the groove and a flange above the groove for abutment with the container adjacent the edge. The main body converges conically to a lower section. The inner core is upwardly insertable into the bore to seal therewith and has a flange to limit insertion. When inserted in the bore the inner core is downwardly ejectable from the hole fitting. The inner core has a middle section which on insertion of the core is adjacent the main body at an upper section of the main body of larger external diameter than the opening. The middle section of the core has an external diameter which is less than the internal diameter of the inner bore at the upper section of the hole fitting.

The difference in diameter between the middle section of the inner core and the inner bore at the upper section of the hole fitting provides a chamber into which the upper section may be urged as the stopper is pressed into a container opening. Such urging readily permits a local reduction in the external diameter of the main body and makes it easier to fit the stopper. Since the hole fitting is of resilient material, the main body reassumes its relaxed state after the pressing in of the stopper.

The hole fitting can have a generally cylindrical bore with sealing beads disposed on its surface in the region of the annular groove. It is then advantageous if the outer diameter of the inner core in this region is smaller than the inner diameter of the sealing beads. In this case, it is also easy to compress the hole fitting in the region of the conical portion.

According to a preferred construction of the invention, the generally cylindrical bore has at least two spaced apart sealing beads which are disposed in the region of the groove, and the inner core carries at its upper end a sealing flange having an outer diameter greater than the inner diameter of the generally cylindrical inner bore in the length between these sealing beads. By means of this construction, on the one hand the inner bore can be completely sealed against soiling at its upper end when the inner core is completely inserted, and on the other hand the sealing flange can ensure sealing of the container interior as the inner core is pushed out using a conventional discharge fitting with shaft. Such sealing action is achieved by the shaft lying tightly against the inner wall of the bore of the hole fitting in the region between the two beads. In this position, the shaft which slides the inner core out of the hole fitting can lie against the upper sealing bead, and so form part of the sealing.

The inner core can have a concave centering recess in its upper face. Such a recess can simplify insertion of the discharge fitting shaft.

In order to obtain a reliable seal between the inner core and the hole fitting, the generally cylindrical inner bore can have at least one sealing bead in its lower region which when the inner core is inserted engages tightly in a corresponding annular groove of the core. It is further advantageous for the hole fitting to be in the form of a sealing bead at its lower edge, which bead can lie against the lower flange of the inner core when this latter is inserted.

Because of the form-fit seal between the inner core and hole fitting, there is sometimes a danger of the hole fitting being forced through the container opening when one is pressing the inner core out of the hole fitting. The container would thus become unsealed, which is undersirable. In this connection, it is advantageous if the flange of the hole fitting is strengthened in its central region overlying the edge of the container. This gives an increased stability to the hole fitting in the region of the container opening.

Further, the lower wall of the circumferential groove of the hole fitting can be connected to the inward base of the groove by way of an inclined face. The opening of the container is typically defined by a downwardly bent edge of the container lid and this edge has sharp edges by virtue of the opening in the lid being punched inwards. The bent edge engages in the inclined face of the groove, with the sharp edges engaging in the soft resilient material in a manner similar to teeth, so giving an additional hold.

By means of this additional fixing of the hole fitting in its slid-in position in the lid, it is possible to hold the inner core relatively fixed in the hole fitting, to obtain further improved sealing properties.

According to a further advantageous embodiment of the invention, the inner bore has a bead disposed in the region below the annular groove, and the outer diameter of the inner core in the region lying opposite this bead when the inner core is inserted is equal to the inner diameter of the bead.

This embodiment provides a support for the hole fitting on the inner core, because the bead is pressed against the inner core by the pressure inside the container. Moreover, a non-sealing intermediate space is formed between the inner wall of the hole fitting and the outer wall of the inner core in the regions adjacent to this bead, so that the hole fitting can again be compressed as it is pushed in, so facilitating the pushing-in operation.

In a further preferred embodiment of the invention, the lower region of the inner bore has at least one sealing bead which when the inner core is inserted engages tightly in a corresponding annular groove of the core, the inner core has an annular shoulder above this annular groove, and the inner bore has between the upper and lower sealing bead a further sealing bead which lies tightly against the top of the annular shoulder when the inner core is inserted.

As such there is trouble-free sealing of the inner core against the hole fitting. If this sealing bead above the annular shoulder is not present, there is the danger that because of the high force acting on the inner core, the inner core will be so strongly pressed into the hole fitting that the seal between the lower sealing bead and annular groove in the inner core will be weakened. By providing a further sealing bead above the annular shoulder, the inner core becomes so reliably fixed in the hole fitting that a trouble-free seal can be attained.

It is advantageous if the distance between the upper bead and lower sealing bead is chosen such that when the inner core is being downwardly ejected, its upper sealing flange rests tightly against the upper bead as soon as the annular shoulder has passed the lower sealing bead.

During ejection, a reliable seal is always ensured, firstly at the beginning of the ejection process by the annular shoulder lying against the lower sealing bead, then by the sealing flange lying against the upper bead, and finally by the presence of the shaft, with which the inner core is ejected, lying against the upper bead.

The other subsidiary claims relate to further advantageous embodiments of the invention which will be apparent.

DETAILED DESCRIPTION OF THE EMBODIMENTS OF THE DRAWINGS

Figure 1:
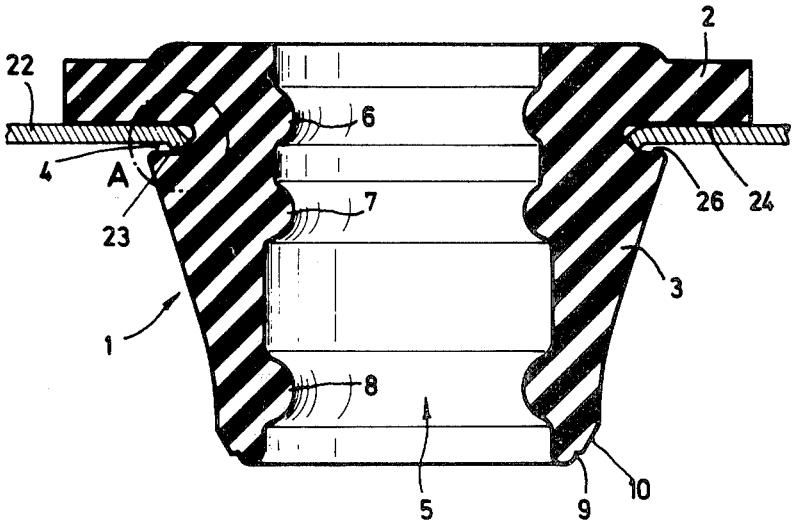
FIG. 1 is a section through a hole fitting of the invention.

The hole fitting 1 illustrated in section in FIG. 1 is akin to a grommet and is formed in one piece of a resilient soft material, preferably rubber. It comprises a plate-like retention flange 2 and a main body or insert portion 3 disposed beneath the flange 2. The insert portion 3 is conical in its upper region and for most of its length, but gradually transforms to a cylindrical shape in its lower region. An annular circumferential groove 4 is provided between the retention flange 2 and the insert portion 3.

First and second annular sealing beads 6 and 7 are disposed in the upper region of a center inner throughbore 5, and are spaced apart such that the first sealing bead 6 lies mainly above the circumferential groove 4 and the second sealing bead 7 below this groove. The inner bore 5 also carries a third annular sealing bead 8 in its lower gegion. All three sealing beads have an approximately circular arcuate cross-section. The lower edge 9 of the hole fitting is in the form of a sealing bead with a circular arcuate cross-section. At its lower end, the hole fitting 1 is bevelled in region 10 adjacent to the lower edge 9.

Figure 2:
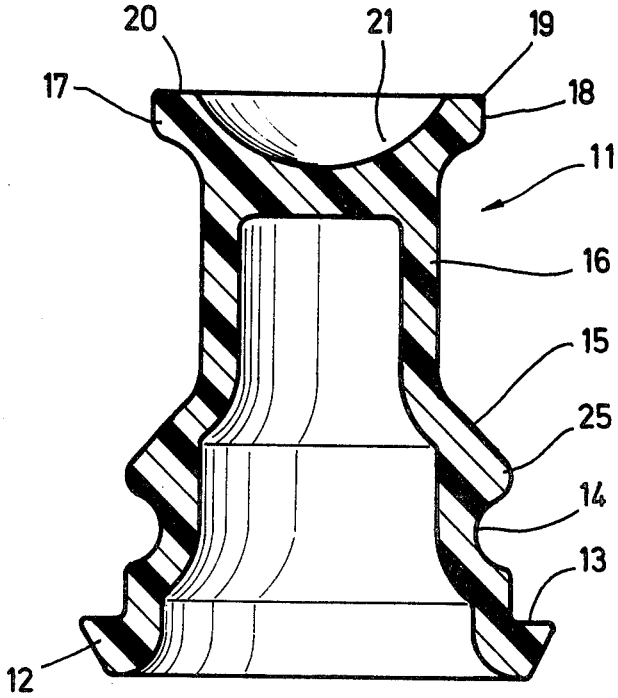
FIG. 2 is a section through an inner core of the invention which can be pressed into the hole fitting of FIG. 1 to form a stopper.

FIG. 2 shows an inner core 11 which together with the hole fitting 1 forms a stopper for a generally circular opening of a container. This inner core 11 is also formed in one piece, and is of a harder material than the hole fitting, for example a hard synthetic plastics material.

The inner core 11 has a generally cylindrical form, and is closed at its top. At its bottom, open end the lower edge is in the form of a support flange 12 turned radially outwards with an upper face 13. In the lower region of the inner core 11 there is an annular circumferential groove 14 with a circular arcuate cross-section, its radius being slightly smaller than the radius of the third seal bead 8 of the hole fitting 1. The inner core 3 tapers above the circumferential groove 14 and conical region 15 to a cylindrical upper section 16 of smaller outer diameter. Between the circumferential groove 14 and conical region 15 there is a projecting annular shoulder 25. At the top of the inner core, the upper section 16 widens by way of a generally S- shaped profile into the form of a seal flange 17. The outer diameter of the seal flange 17 is slightly greater than the inner diameter of the bore of the hole fitting 1 in the region above the first sealing bead 6 and between the first and second seal beads 6 and 7. Vertical side surface 18 of the sealing flange 17 transforms to the upper face 20 of the inner core by way of a sharp corner 19. A central recess 21 with a circular arcuate cross-section is provided in the otherwise flat upper face 20 of the core 11.

The dimensions of the inner core 11 and hole fitting 1 are so related to each other that the inner core can be pressed upwardly into the inner bore 5 of the hole fitting 1 and then lie with the upwardly-directed face 13 of the support flange 12 abutting against the lower bead-shaped edge 9 of the hole fitting 1. The third sealing bead 8 snaps into the circumferential groove 14, and the sealing flange 17 lies tightly on the inner wall of the inner bore 5 above the first sealing bead 6, with the top face 20 of the inner core being flush with the top face of the hole fitting. The outer diameter of the upper portion 16 of the inner core 11 is chosen such that a gap remains between the first and second sealing beads 6 and 7 and the inner core 11.

In using the hole fitting 1 and inner core 11 to form a stopper of the invention, the inner core is pressed from below into the inner bore 5 of the hole fitting 1. The hole fitting with inserted inner core is then pressed into the opening to be closed, for example into the opening in lid 22 of a can filled with beer. The downwardly tapering insert portion of the hole fitting 1 facilitates this closure action, and is compressed since its outer diameter, at least in the upper portion, is greater than the diameter of the opening. This compression of insert portion 3 is made easy by the invention since the upper portion 16 of the inner core has a small diameter and does not lie against the first and second sealing beads 6 and 7. As soon as the upper edge of the insert portion 3, i.e. the lower side wall of the circumferential groove 4, has been slid past edge 23 of the lid 22, the edge 23 of the lid 22 snaps into the circumferential groove 4. The flat lower face 24 of the retention flange 2 then lies flat on the lid 22 and the opening is sealed against pressure. The seal is provided firstly by the hole fitting 1 being pressed against the edge 23 of the lid 22 by the pressure inside the container, and secondly by the inner bore 5 being tightly closed by the inner core 11. This second sealing effect is provided by a double acting seal, namely by the bead-shaped edge 9 lying against the face 13 of the flange 12, and by the engagement of the third sealing bead 8 in the circumferential groove 14.

The inner bore 5 is sealed against dust at its upper end by the sealing flange 17. As the upper end 20 of the inner core 11 and the upper end of the hole fitting 1 close flush with each other, no ridges or projections are formed on which dirt could deposit. Any deposition in the round recess 21 can be easily removed before opening the stopper.

To open the stopper, a conventional dispenser or discharge fitting is employed. Such discharge fittings are well known to the skilled man and widely available. The particular fitting selected has a shaft of outer diameter marginally greater than the inner diameter of the sealing beads 6, 7 and 8. The lower end of the shaft of the discharge fitting is placed in the recess 21, and the discharge fitting is firmly pressed against the inner core 11. By this means, the inner core is then pushed downwards from the hole fitting 1 in an axial direction to be replaced by the shaft of the discharge fitting. The container interior remains sealed against atmosphere during the total ejection of the inner core from the hole fitting 1. Firstly, the seal flange 17 is slid over the first sealing bead 6, and the annular shoulder 25 between the circumferential groove 14 and conical region 15 (FIG. 2) is slid over the third sealing bead 8. The sealing flange 17 then lies tightly on the inner cylindrical wall between the first and second sealing beads 6 and 7. At the same time, the shaft, which as mentioned has an outer diameter greater than the inner diameter of the sealing beads 6, 7 and 8, comes into contact with the upper, first sealing bead 6. As ejection proceeds, the sealing flange 17 slides past the lower, second sealing bead 7, during which a good sealing action is again attained. As soon as the sealing flange 17 passes the second sealing bead 7, the inserted shaft lies tightly against the bead 7. The sealing beads 6 and 7 in cooperation with the shaft then supply a complete seal during further ejection of the inner core 11. When the shaft is completely inserted, it also rests against the third sealing bead 8. The liquid in the container, beer in this instance, can then be drawn off using the conventional discharge fitting.

The described stopper of the invention ensures that a satisfactory seal is obtained for every depth of insertion of the shaft, and the corresponding position of the inner core. This action is assisted in particular by the cooperation between the upper sealing flange 17 and the spaced-apart sealing beads 6 and 7.

It is also advantageous that the force exerted by the shaft on the inner core is centered by the recess 21, and therefore practically no noticeable radial force acts on the inner core. The danger of leakage between the hole fitting and lid edge is therefore considerably lessened.

Figure 3:
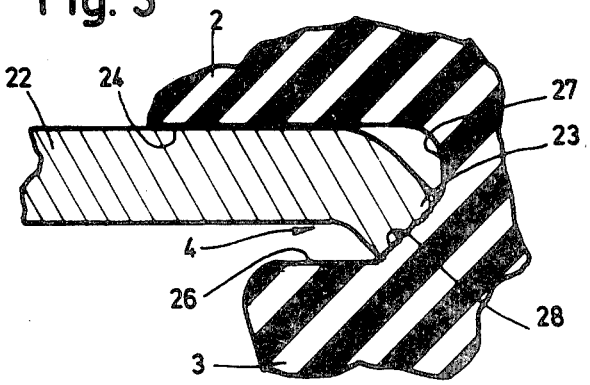
FIG. 3 is a detailed view to an enlarged scale of portion A of the hole fitting of FIG. 1.

Due to the form-fit tight connection between the hole fitting 1 and the inner core 11, it is often found that a considerable force is exerted on the hole fitting during the opening of the stopper, i.e. as the inner core is forced into the container interior. This force tends also to push the hole fitting through the lid opening, and in order to ensure the reliable retention of the hole fitting 1 in the lid opening, the retention flange 2 is strengthened in its central region covering the lid edge. In addition, the circumferential groove 4 has a special cross-sectional shape, as shown in FIG. 3. The lower side wall 26 joins the base 27 of the groove by way of an inclined surface 28. The downwardly bent edge 23 of the lid 22, which comprises sharp corners due to the fact that the opening is punched out, engages in this inclined surface 28 in the manner of teeth, so that a particularly intimate connection is obtained between the lid edge 23 and hole fitting 1. This gives an improved seal between the stopper and lid, and also leads to better fixing of the hole fitting on the lid.

The improved fixing of the hole fitting on the lid also makes it possible to increase the sealing action of the inner core in the hole fitting.

In this respect, the dimensions of the third bead 8 and groove 14 can be chosen such that the bead 8 is pressed firmly into the groove 14. Although the inner core is more firmly connected to the hole fitting because of this, the inner core can nevertheless be ejected from the hole fitting, obviously by using a greater force, without the position of the hole fitting changing because of this.

Thus, although the insertion of the hole fitting into the lid opening is considerably simplified over known stoppers because of the smaller outer diameter of the inner core, a lasting seating for the hole fitting in the lid opening is obtained, and because of this the sealing properties of the stopper can be substantially improved.

Figure 5:
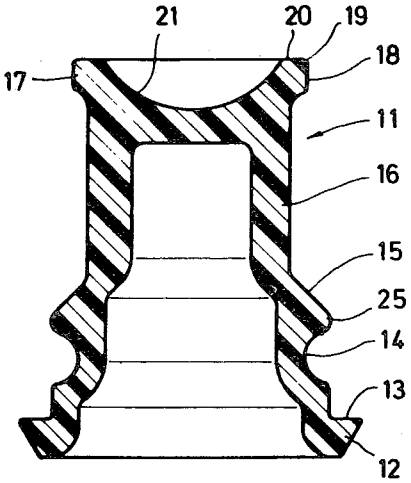
FIG. 5 is a section through an inner core of the invention which can be pressed into the hole fitting of FIG. 4 to form a stopper.
Figure 4:
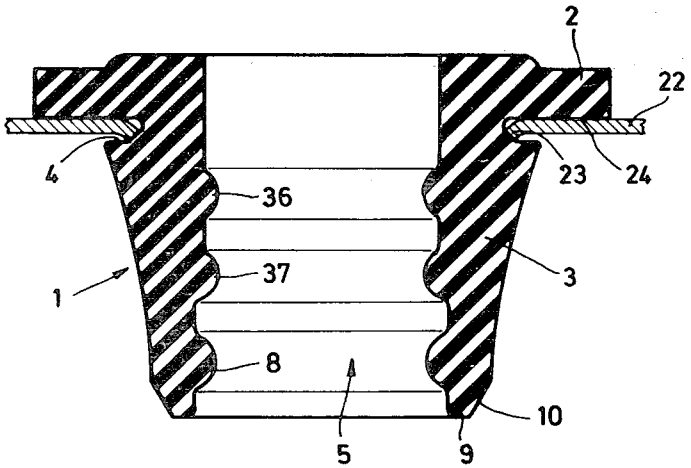
FIG. 4 is a section through another hole fitting of the invention.
Figure 6:
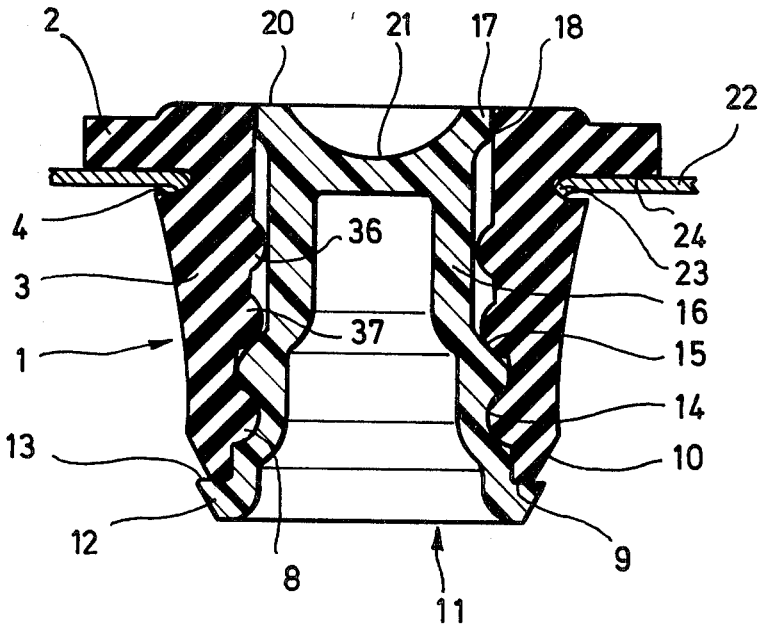
FIG. 6 is a sectional view of the stopper of FIG. 5 positioned in the fitting of FIG. 4.

The embodiment of the invention illustrated in FIGS. 4 and 5 substanially resembles that described with reference to FIGS. 1 to 3, and corresponding parts therefore carry the same reference numeral.

An upper, first bead 36 is disposed in the region below the circumferential groove 4 in the central inner through-bore 5. In its lower region, the inner bore comprises a third annular sealing bead 8. A second sealing bead 37 is located in the region between the two beads 36 and 8. All three sealing beads have an approximately circualr arcuate cross-section.

The inner core 11 (FIG. 5) is of substantially cylindrical form, and is closed at its upper end. At its upper end, the inner core widens out in the form of a sealing flange 17, the outer diameter of which is slightly greater than the inner diameter of the inner bore in the hole fitting in the region above the first sealing bead 36 and between the first and second sealing beads 36 and 37.

The dimensions of the inner core and the hole fitting are related to each other such that the sealing flange 37 can lie tightly on the upper face of the annular shoulder 25. The sealing flange 17 can seal against the inner wall of the inner bore 5 above the first bead 36, such that the upper face 20 of the inner core is flush with the upper face of the hole fitting.

In this embodiment, the outer diameter of the upper portion 16 is so chosen that on the one hand an intermediate space remains between inner wall of the inner bore 5 and the outer wall of the inner core, while on the other hand the sealing beads 36 and 37, and in particular the first sealing bead 36, lie against the outside of the inner core. The inner core thus has an outer diameter which is substantially equal to the inner diameter of the first bead 36.

The distance between the first bead 36 and third bead 8 is so chosen that during ejection, the sealing flange 17 of the inner core rests tightly against the first bead 36 as soon as the annular shoulder 25 has passed the third bead 8. At this stage, the sealing flange 17 lies tightly against the top of the first bead 36, and the annular shoulder 25 lies tightly against the bottom of the third sealing bead 8.

An effective support for the hole fitting 1 is provided by the fact that the first bead 36, which is located principally in the region of the largest accumulation of material below the circumferential groove 4, lies against the outer wall of the inner core, so that the hole fitting cannot be contracted together under the influence of the high pressure in the container interior. In this manner, an excellent seal can be obtained between the hole fitting and container lid.

To open the stopper, the lower end of the shaft of a conventional discharge fitting is placed in the recess 21 and is firmly pressed against the inner core 11. By this means, the inner core is ejected downwards out of the hole fitting in an axial direction. The seal between the container interior and atmosphere remains unbroken during the total ejection of the inner core. Firstly, the annular shoulder 25 is slid past the lower, third seal bead 8, during which the annular shoulder 25 and seal bead 8 provide a complete seal. Even before the annular shoulder 25 has slid completely past the bead 8, the sealing flange 17 lies tightly on the upper, first bead 36, so that a new seal is formed here. As the shaft of the discharge fitting advances further, it comes into contact with the upper sealing bead 36 because the outer diameter of the shaft is greater than the inner diameter of the sealing beads 36, 37 and 8. The shaft then provides the seal during the completion of ejection. Liquid can then be dispensed from the container using the discharge fitting.

I claim:

1. A stopper for a pressure container which has a generally circular edge defining an opening of said container, said stopper comprising a hole fitting of resilient material with a substantially cylindrical inner bore and an inner core of substantially the same height as the hole fitting for insertion in said bore to seal thereagainst; said hole fitting having an annular external groove for receiving said generally circular edge of said container and having a main body below said groove and a flange above said groove for abutment with said container adjacent said edge, said main body converging conically to a lower secton; said inner core being upwardly insertable into said bore to seal therewith and having a flange to limit insertion, said inner core when inserted in said bore being downwardly ejectable from said hole fitting and said inner core having a middle section which on insertion of said core is adjacent said main body at an upper section of said main body of larger external diameter than said opening, said middle section of said core having an external diameter which is less than the internal diameter of said inner bore at said upper section of said hole fitting.

2. The stopper of claim 1, wherein said generally cylindrical inner core of said hole fitting has one or more sealing beads disposed in the region of said annular external groove of said inner core, the outer diameter of said inner core in said region being smaller than the inner diameter of said sealing beads.

3. The stopper of claim 2, wherein there are at least two sealing beads disposed spaced apart in the region of said annular external groove, and said inner core carries at its upper end a sealing flange having an outer diameter greater than the inner diameter of said inner bore between said at least two sealing beads.

4. The stopper of claim 3, wherein said hole fitting and said inner bore are dimensioned such that when the inner core is inserted, said sealing flange at the upper end of said inner core is disposed above that sealing bead which is uppermost.

5. The stopper of claim 1, wherein said hole fitting and said inner bore are dimensioned such that when the inner core is inserted, said inner core is substantially flush with the top face of the hole fitting.

6. The stopper of claim 1, wherein said inner core has a concave centering recess on its top face.

7. The stopper of claim 1, wherein said generally cylindrical inner bore of said hole fitting comprises at least one sealing bead in its lower region and which, when said inner core is inserted, engages tightly in a corresponding annular groove of said inner core.

8. The stopper of claim 1, wherein said hole fitting is in the form of a sealing bead at its lower edge, said sealing bead lying against said flange of said inner core when said core is inserted.

9. The stopper of claim 1, wherein said flange of said hole fitting is strengthened in its central region.

10. The stopper of claim 1, wherein said annular, external groove has a lower wall connected to the inner base of said groove by an inclined face.

11. The stopper of claim 1, wherein said inner bore has a first bead below said annular groove, and the outer diameter of said inner core opposite said bead when said inner core is inserted is equal to the inner diameter of said bead.

12. The stopper of claim 11, wherein said inner bore has a second sealing bead below said first bead and comprises a further, third sealing bead which when said inner core is inserted lies tightly against the top of an annular shoulder of said inner core.

13. The stopper of claim 12, wherein the distance between said first bead and said second sealing bead is such that when said inner core is being ejected, said flange of said inner core rests tightly against said first bead as soon as said annular shoulder has passed said second sealing bead.

* * * * *

UNITED STATES PATENT AND TRADEMARK OFFICE

CERTIFICATE OF CORRECTION

PATENT NO. : 4,202,463

DATED : May 13, 1980

INVENTOR(S) : Joachim Mogler

It is certified that error appears in the above—identified patent and that said Letters Patent is hereby corrected as shown below:

On the cover page, under Foreign Application Priority Data, "February 19, 1978" should read -- February 17, 1978 --.

Signed and Sealed this

Second Day of September 198

[SEAL]

Attest:

SIDNEY A. DIAMOND

Attesting Officer

Commissioner of Patents and Trademark: